United States Patent [19]

Natsume

[11] Patent Number: 5,030,130

[45] Date of Patent: Jul. 9, 1991

[54] CONNECTOR

[75] Inventor: Yoshihisa Natsume, Kosai, Japan

[73] Assignee: Yazaki Corporation, Tokyo, Japan

[21] Appl. No.: 518,633

[22] Filed: May 2, 1990

Related U.S. Application Data

[63] Continuation of Ser. No. 284,879, Dec. 15, 1988, abandoned.

[30] Foreign Application Priority Data

Dec. 16, 1987 [JP] Japan ..... 62-189970

[51] Int. Cl.[5] ..... H01R 13/629

[52] U.S. Cl. ..... 439/374

[58] Field of Search ..... 439/374, 377, 375, 376

[56] References Cited

U.S. PATENT DOCUMENTS 3,768,066 10/1973 Mattingly, Jr. et al. ..... 439/377
4,350,401 9/1982 Allen et al. ..... 439/374
4,509,815 4/1985 Kischer et al. ..... 439/377
4,572,602 2/1986 Rupnik ..... 439/374
4,579,408 4/1986 Sasaki ..... 439/374

FOREIGN PATENT DOCUMENTS 0182065 5/1986 European Pat. Off. ..... 439/374
58-73575 5/1983 Japan .

*Primary Examiner*—Gary F. Paumen
*Attorney, Agent, or Firm*—Armstrong, Nikaido, Marmelstein, Kubovcik, & Murray

[57] ABSTRACT

A connector comprises a male connector housing and a female connector housing. The female housing is provided with a guide wall for guiding the male housing thereinto. The guide wall is formed of a plurality of wall members, each of which is connected at lateral ends thereof to the other walls. The wall members recede rearwardly from both lateral ends toward an axial center line thereof.

3 Claims, 4 Drawing Sheets

CONNECTOR

This is a continuation of application Ser. No. 284,879 filed Dec. 15, 1988 now abandoned.

BACKGROUND OF THE INVENTION

1. Field of the Invention

The present invention relates to a technique for facilitating fitting of a male connector housing into a female connector housing and moreparticularly to a shape of the guide wall of the female connector housing for guiding the male connector thereinto.

2. Description of Prior Art

A connector housing is commonly provided with a guide wall for guiding electrical contacting pins or male terminals into female terminals to prevent deformation of the contacting terminals due to a force unexpectedly applied thereto when inserting the male connector housing into the female connector housing. FIG. 5 illustrates an example of one such connector housing having a guide wall.

Referring to FIG. 5, there is shown a male connector housing 2, which is to be inserted into a female connector housing 1. A rib 13 is provided to prevent a guide wall 11 from deflecting into the inner side of the housing as a result of the injection molding process. The rib 13 fits to a groove 23 of the male connector housing 2 when the female connector housing 1 receives the male connector housing 2.

Conventionally connector housings such as those shown in FIG. 5 have been used in order to avoid exerting any deforming force on the connector housing even though it is more effective not to have a gap between the inner surface of the guide wall 11*b* and the outer wall of the male connector housing.

On the other hand, frictional forces developed between the wall surfaces of the male and female connector housings often causes excessive drag when drawing the male connector housing out of the female connector housing as well as an excessive resistive force against the insertion force applied to insert the male connector housing into the female connector housing. Japanese Utility Model KOKAI No. 58-73575 discloses one type of connectors for overcoming the aforementioned drawback as shown in FIGS. 6 and 7. The connector is provided with a shallow recess 14 except in proximity to the corner portions 12. The area spanned by the recess 14 is subject to the largest deforming force and is reinforced with a rib 13 to reduce the frictional force acting on the portion 14 to facilitate smooth fitting of the connectors.

However, the rib 13 provided on the connector shown in FIG. 6 is not strong enough to effectively prevent deflection of the guide wall 11 into the inner space defined by the guide wall, as shown by phantom lines in FIG. 7. Deflection of the guide wall 11 in this manner causes the inwardly projecting portion of the wall 11 to push or press against the fitting surface of the male connector 2, thereby causing difficulty in fitting the male connector housing into the female connector housing.

SUMMARY OF THE INVENTION

Thus the present invention was made to overcome the aforementioned drawbacks and provides a connector which allows smooth insertion of the male connector housing into the female connector housing and good fitting relation therebetween even if part of the guide wall deflects into the inner space defined by the guide wall.

To accomplish the aforementioned object, a connector according to the present invention is arranged in such a way that at least one of the wall members increasingly recedes rearwardly with respect to an engagement direction from both lateral ends toward an axial center line thereof.

BRIEF DESCRIPTION OF THE DRAWINGS

The present invention will now be described in detail with reference to the drawings in which;

FIG. 2*a* is a perspective view of the connectors when fitting is just started.

DESCRIPTION OF THE EMBODIMENT

Figure 1:
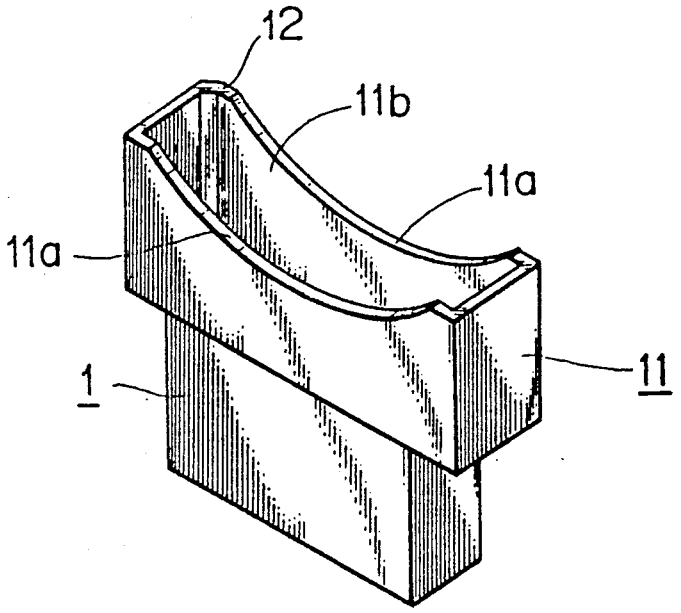
FIG. 1 is a perspective view of a first embodiment of a connector housing according to the present invention.

The present invention will now be described with reference to FIG. 1 and FIG. 2. Male and female conductive terminals are not shown but are retained within the male and female connector housings in these figures for electrical connection therebetween when the male and female connector housings are fit to each other. In FIG. 1, a fitting surface 11*a* of a guide wall 11 of the female connector housing 1 recedes in an arcuate curve with respect to an engagement direction from both lateral ends toward an axial center line thereof. This is so formed for the reason described later. FIG. 2 illustrates the male connector housing 2 fitting into the female connector housing 1. The female connector housing 1 is formed through, for example, injection molding, during which the guide wall deflects due to shrinkage. According to the present invention, this shrinkage will not disturb fitting relation between the male and female connector housings 1, 2 for the following reason.

Figure 2A:
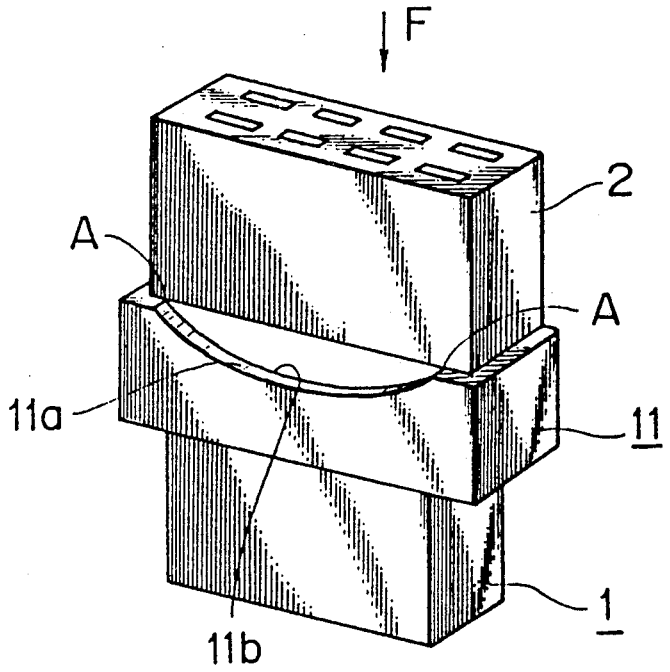
FIGS. 2*a* and *b* show male and female connector housings being fitted to each other.
Figure 2B:
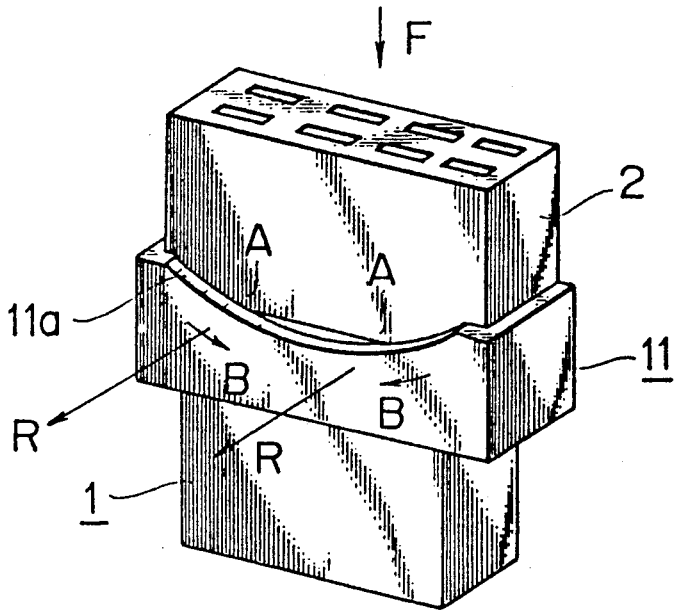
FIG. 2*b* is a perspective view of the connectors when the male connector housing is moved further into the female connector housing.
Figure 6:
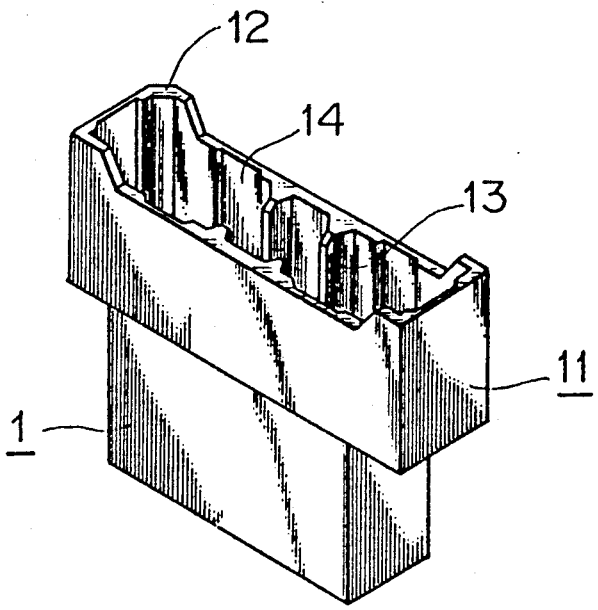
FIG. 6 PRIOR ART
FIG. 6 is a perspective view for showing another prior art connector housing.
Figure 7:
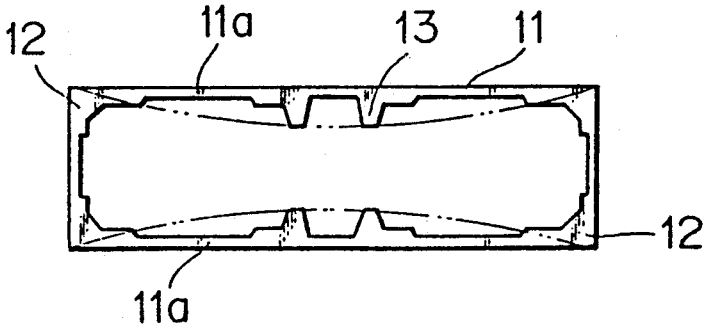
FIG. 7 PRIOR ART
FIG. 7 is a top view of FIG. 6.

The male connector housing 2 is inserted into the female connector so that they fit to each other as shown in FIG. 2*a*. As shown in FIG. 6, the guide wall is formed thick enough at the respective corner portions 12 so that the corner portions 12 will not deflect inwardly. Thus the male connector housing 2 can be inserted without difficulty at an early stage of insertion. At this time, the male connector housing 2 is in contact with the female connector housing 1 at contacting points A. Since the guide wall 11 is progressively deflected inwardly at the fitting surface 11*a* with increasing distance from the corner portions 12, the contacting point A moves gradually toward the middle of the fitting surface 11*a* in the direction of B as the male connector housing is pushed further into the guide wall 11. It should be noted that the fitting begins in the vicinity of the corner portions 12 of the female connector housing 1 where deflection is not significant. Thus the male connector housing 2 acts like a wedge so that the male connector housing 2 will wedge away the inwardly deflected wall 11*a* in the direction of R thereby gradually correcting the deflection. Therefore the movement of the male connector housing 2 into the female connector housing 1 will not be disturbed by the deflection of the guide wall caused during forming by injection molding.

Figure 3:
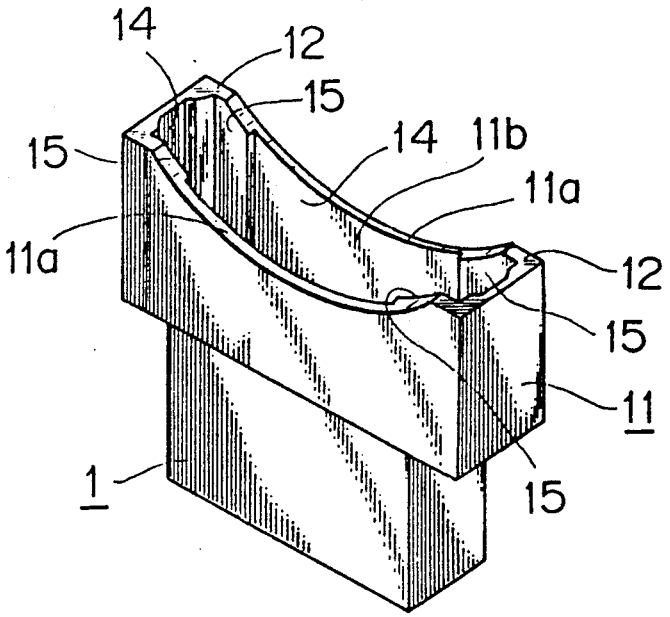
FIG. 3 is a perspective view of a second embodiment of the connector according to the invention.

FIG. 3 illustrates a second embodiment of the invention in which a shallow recess 14 is formed at portions except for the corner portions 12 of the guide wall 11. In this embodiment, the male connector housing first engages with the guide wall 11 at stepped portions 15 in fitting relation when it is inserted into the female connector housing. Then the male connector housing is further moved into the space defined by the guide wall but will contact with an fitting surface 11*b* except for portions in which the shallow recess is provided. The shallow recess 14 serves to eliminate the friction otherwise developed between the male connector housing, thus permitting ease of connector fitting.

The arcuate shape of the edge 11*a* of the fitting surface 11*b* of the guide wall 11 is only exemplary and may be of other shapes e.g., straight lines that forms a guide wall progressively short in height with increasing distance from the corner portions.

Figure 4:
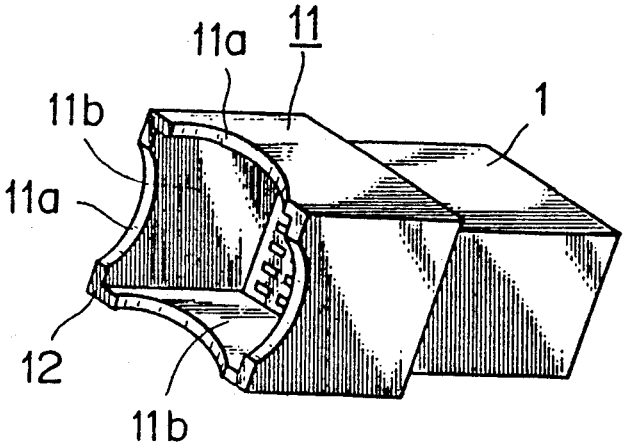
FIG. 4 is a perspective view of a female connector housing of a third embodiment of the invention.
Figure 5:
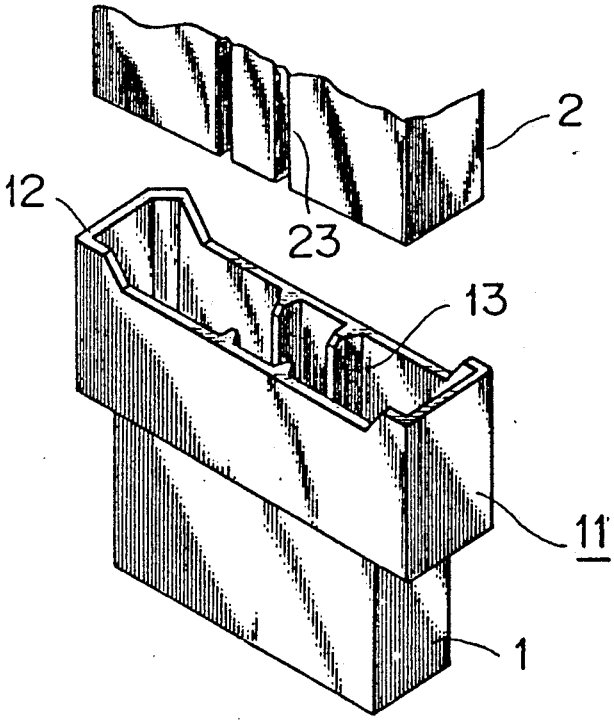
FIG. 5 PRIOR ART
FIG. 5 is a perspective view of a prior art male and female connector housing.

FIG. 4 shows a third embodiment of the invention in which the height of the four guide walls in relatively high. With this type of guide wall, the guide wall 11 is formed to recede increasingly rearwardly with increasing distance from the corner portions 12. Additionally, a shallow recess as shown in FIG. 3 may be formed on the inner wall surface 11*a* of the guide wall 11. The present invention is particularly advantageous when applied to connector housings having a high, thin, and long guide wall in which a large deflection is developed. Applications include not only male-female connectors but also connectors in an electrical connection box or junction box used in wiring for vehicles.

According to the present invention thus far described, the guide wall of a connector housing is formed to recede rearwardly with respect to an engagement direction from both ends toward an axial center line thereof, thus permitting fitting of the male connector housing into the female connector housing without being disturbed by a guide wall which is deflected inwardly. Also the present invention eliminates the necessity of a deflection-preventing rib, thereby allowing more compact sizes of connectors and contributing, together with the progressively shorter wall, to connectors of lighter weight.

What is claimed is:

1. A connector assembly comprising a male connector housing and a female connector housing into which said male conector housing is inserted in mating relation, said female connector housing having a guide wall forming a space through which said male connector housing is inserted in one direction, wherein said guide wall is formed of a plurality of wall members connected at lateral ends thereof to each other and at least one of said wall members continuously recedes in said direction from both lateral ends to an axial center line thereof.

2. A connector assembly according to claim 1, wherein at least one of said wall members is provided with a recess on an inner surface thereof which extends over a substantial area of said inner surface between said ends of said wall member.

3. A connector assembly according to claim 1, wherein at least wo opposed wall members of said wall members have arcuate surfaces receding in said direction.

* * * * *